US010181298B2

(12) United States Patent
Shoshan et al.

(10) Patent No.: US 10,181,298 B2
(45) Date of Patent: Jan. 15, 2019

(54) APPARATUS AND METHOD OF ADJUSTING BACKLIGHTING OF IMAGE DISPLAYS

(71) Applicant: GOOGLE LLC, Mountain View, CA (US)

(72) Inventors: Yoel Shoshan, Haifa (IL); Boris Oicherman, Jerusalem (IL); Ron Weitzman, Bnei Tzion (IL)

(73) Assignee: Google LLC, Mountain View, CA (US)

( * ) Notice: Subject to any disclaimer, the term of this patent is extended or adjusted under 35 U.S.C. 154(b) by 150 days.

(21) Appl. No.: 15/291,091

(22) Filed: Oct. 12, 2016

(65) Prior Publication Data

US 2017/0110069 A1 Apr. 20, 2017

Related U.S. Application Data

(60) Provisional application No. 62/243,081, filed on Oct. 18, 2015.

(51) Int. Cl.

| | |
|---|---|
| ***G09G 3/34*** | (2006.01) |
| ***G09G 3/36*** | (2006.01) |
| ***G09G 3/20*** | (2006.01) |
| ***G09G 5/02*** | (2006.01) |
| *G09G 5/06* | (2006.01) |

(52) U.S. Cl.

CPC ..... *G09G 3/3413* (2013.01); *G09G 5/026* (2013.01); *G09G 5/06* (2013.01); *G09G 2320/0242* (2013.01); *G09G 2320/08* (2013.01); *G09G 2330/021* (2013.01); *G09G 2330/023* (2013.01); *G09G 2360/08* (2013.01); *G09G 2360/144* (2013.01); *G09G 2360/18* (2013.01)

(58) Field of Classification Search

CPC ..... G09G 2320/0242; G09G 2320/08; G09G 2330/021; G09G 2330/023; G09G 2360/08; G09G 2360/144; G09G 2360/18; G09G 3/3413; G09G 5/026; G09G 5/06

See application file for complete search history.

(56) References Cited

U.S. PATENT DOCUMENTS

2012/0281027 A1* 11/2012 Kim ..... G09G 3/3406 345/690
2014/0078193 A1* 3/2014 Barnhoefer ..... G09G 3/3406 345/690
2014/0267370 A1* 9/2014 Albrecht ..... G09G 5/006 345/602
2014/0325435 A1* 10/2014 Jung ..... G06F 3/0481 715/790
2015/0371593 A1* 12/2015 Hesselmark ..... G09G 3/3413 345/440

* cited by examiner

*Primary Examiner* — Afroza Chowdhury
(74) *Attorney, Agent, or Firm* — Fish & Richardson P.C.

(57) ABSTRACT

A method of reducing power consumption in computing devices with a back light display while maintaining image quality and user's experience includes reducing the native backlight intensity and increasing native pixel values. The reduction of the backlight intensity and the increase of native pixel values is adjusted so that the observed pixel value to the user is substantially the same as the native backlight intensity and the native pixel values.

20 Claims, 4 Drawing Sheets

APPARATUS AND METHOD OF ADJUSTING BACKLIGHTING OF IMAGE DISPLAYS

RELATED APPLICATIONS

This application is related to and claims priority to U.S. Provisional Application Ser. No. 62/243,081, filed Oct. 18, 2015. This application is also related to U.S. patent application Ser. No. 15/249,669, filed Aug. 29, 2016, entitled Processor Programmed for Power Savings, the entirety of which is herein incorporated by reference.

BACKGROUND

Liquid Crystal Displays (LCD) are characterized by a backlight source for generating an image. The backlight is transmitted through an array of pixels filled with liquid crystal materials. Each pixel is electrically controlled. The applied electrical voltage across a pixel defines the amount of light transmitted through the pixel. The amount of light which is transmitted from the backlight source through the liquid crystal pixel may range from zero, which produces a black pixel, to 255 which produces the whitest pixel. The backlight source in an LCD structure is a heavy power consumer. On the other hand, changing the pixel opacity consumes relatively low zero power consumption. There are known techniques to save backlight power by measuring the surrounding ambient light and then adjusting the BLIL (Backlight level) accordingly. Another approach for managing a LCD's backlight in order to reduce power consumption is by measuring or monitoring user's activity so that BLIL is reduced when the user appears to be less active. In all these prior art solutions there is likely a quality deterioration of the image presented to the user and therefore a significant reduction in the overall user's experience. Most of these power saving solutions are directed to inactive states of the screen while high power is still consumed during active states of the screen e.g. watching a video or playing games.

In a typical color LCD, each pixel is composed of three sub-pixels of RGB. The appearance of each pixel to a user's eyes, its color and brightness, is a function of the backlight of the pixel and its opacity value. Content Adaptive Backlight Control (CABC) is known in the art. CABC results in a dimmed backlight and a boosted pixel value to increase its opacity in order to save power and achieve a perceived pixel as intended to be achieved by the original image. Known in the art are 0, 1 and 2 dimensional backlight control. In addition, image histogram analysis is known in order to define the whitest point to display. However, with reduced backlight comes the cost of reduced dynamic range for the pixel. This may lead to artifacts such as clipped pixels or washout when higher brightness is required but can't be produced.

One solution known in the prior art to avoid washout of pixels is to analyze the whites point for each color separately and use the whitest point among all colors as the most upper brightness limit to be practiced. In addition, changing the BLL while an application is running may lead to flickering artifacts.

Another issue relevant to the known systems is that adjustments are made on an overall basis across different applications (such as games) and not keyed to the particular needs of an application or game on an individual basis. This may result in inefficient adjustments of BLIL and pixel values and may not efficiently reduce power consumption. Therefore, there is a need to have a CABC and pixel value control system that conserves power and which is keyed to the individual application, program or game being played at any given time that reduces artifacts while minimizing original image quality deterioration. In addition, there is a need for a system and method which facilitates the background processing of individual applications and games for the "best" balance of BLIL and pixel values offline so that the mobile device does not consume excessive power in "real time" while, for example, a game is being played. It is to address these issues that the present application is directed.

Terminology Used in the Present Invention

BL—Back light, for the purpose of this invention, is any source of light, whether internal or external to a display panel or to its pixels and whether totally or locally dimmable that is required to convey the display or the pixel image to the user eye.

BLIL—is light intensity level produced by the BL.

Observed Pixel Color—is the color of a pixel as perceived by an observer's eye. The observed pixel color is a function of some internal factors of the display system and some external factors, such as ambient lightening or display orientation, as well as the observer vision characteristics.

Pixel Value—for the sake of simplicity, we will use the expression of the pixel values as RGB triplet (R, G, B), each component of which can vary from zero to a defined maximum value. The lower the number, the darker the pixel. The higher the number, the brighter the pixel. These ranges may be quantified in several different ways such as, for example, a fraction from 0 to 1, as a percentage from 0% to 100%, as an integer represented by either decimal or hexadecimal number (in an 8-bit system the range is 0-255, in a 10-bit system the range is 0-1023, in a 16-bit system the range is 0-65535 etc.). However, it is also possible that the pixel value will be represented in any color space, for example, HSV (Hue, Saturation, Value), conversion of the principles mentioned here into a different color space should be trivial to the trained in the relevant art.

SUMMARY OF THE INVENTION

In an aspect, a method of reducing power consumption in computing devices that have a back light display while at the same time maintaining image quality and user's experience includes reducing the native backlight intensity and increasing native pixel values.

In another aspect, the reduction of the backlight intensity and the increase of native pixel values is adjusted so that the observed pixel value to the user is substantially the same as the native backlight intensity and the native pixel values. The method includes the steps of: sampling native frame pixels in a frame buffer; analyzing the native frame pixels to determine native pixel values; monitoring back light intensity for the sampled native frame pixels; based on the analyzing and monitoring steps, determining whether power consumption may be reduced for the native frame pixels; and, if so, generating a corrected set of pixel values and backlight intensity.

In a further aspect, the method further includes the step of estimating the power consumption to perform the generating step compared with the power consumption of generating the corrected set of pixel values and backlight intensity; and, determining whether to generate a corrected set of pixel values and backlight intensity dependent on the comparing step.

In yet another aspect, the method further includes the step of sampling and analyzing a predetermined number of frames, where the sampling including the steps of: determining the native pixel value and the native backlight intensity of the predetermined number of frames; calculating expected power consumption savings based on the difference between the estimated cost of frame sampling and analysis and the expected power consumption reduction due to reducing the backlight intensity; and, if the difference is at or above a predetermined threshold, implementing the step of reducing native backlight intensity and increasing native pixel values.

In a further aspect, the steps of reducing native backlight intensity and increasing native pixel values is performed on an application-by-application basis. The steps of sampling, analyzing, monitoring, determining and generating are implemented on an application-by-application basis. The back light display may be contained in a battery-powered mobile device.

In yet a further aspect, the method further includes providing a non-mobile computing device, the battery-powered mobile device and the non-mobile device being in communication, and wherein one or more frames are preprocessed by the non-mobile computing device in one or more of the steps recited and made available to the mobile device to determine whether to generate a corrected set of pixel values and backlight intensity in order to save power consumption. The method may also include providing a non-mobile computing device, the battery-powered mobile device and the non-mobile computing device being in communication, further comprising the steps of the non-mobile computing device preprocessing one or more frames according to one or more of the steps storing the frames preprocessed, and on demand forwarding the preprocessed frames to the mobile device.

In yet another aspect, the method further may include the step of the mobile device transmitting one or more of: the user's ambient light condition, battery state, backlight intensity, mobile device temperature to the non-mobile computing device, the non-mobile computing device preprocessing the one or more frames in accordance with one or more of the steps based on the data transmitted from the mobile device to implement power consumption savings.

In an aspect, the steps of reducing the backlight intensity and increasing the pixel values may be implemented by one or more of: (a) adding software instructions to a GPU shader to change the pixel values and (b) providing a lookup table (LUT), wherein the LUT is pre-loaded with instructions on an application-by-application basis.

In another aspect, an apparatus for reducing power consumption in a computing device includes: at least one CPU, a memory, one or more sets of instructions contained in the memory, one or more applications running on the computing system, a backlight display, the computing device being capable of controlling native backlight intensity and pixel values; wherein the at least one CPU reduces power consumption by reducing the native backlight intensity and increases native pixel values.

In a further aspect, the CPU reduces power consumption by reducing the native backlight intensity and increases the native pixel values by implementing one or more of the functions: (a) adding software instructions to a GPU shader to change the pixel values and (b) providing a lookup table (LUT), wherein the LUT is pre-loaded with instructions on an application-by-application basis.

BRIEF DESCRIPTION OF THE DRAWING FIGURES

DETAILED DESCRIPTION OF THE PRESENT INVENTION

Figure 1:
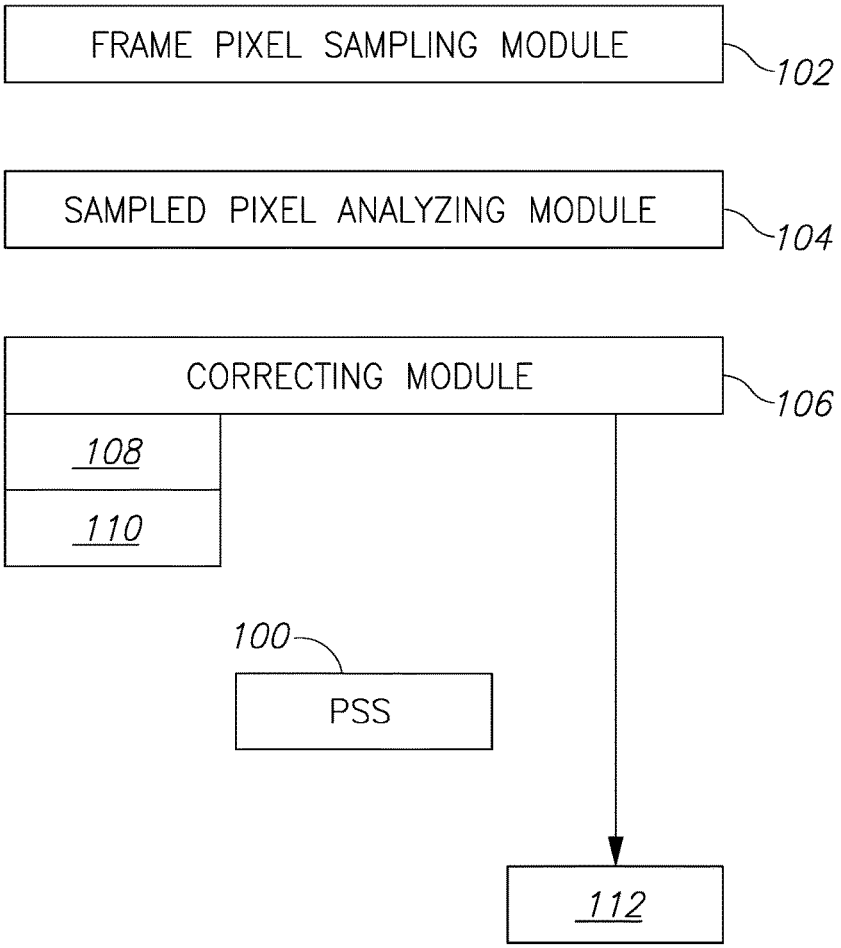
FIG. 1 illustrates in graphic form the Power Save System (PSS) of the present invention.

According to one aspect of the invention, there is provided a system which is configured to reduce the amount of BLIL of a display panel on an individual application or game basis in order to save power without causing significant image quality deterioration as perceived by a user. It is particularly relevant to mobile devices that rely on a battery for power but also relevant to mains-powered devices as well.

Based on this aspect, a pixel's values are corrected in order to compensate for a reduction in BLIL. Reduced BLIL reduces the total power consumption and is critical in battery operated systems such as cell phones, notebooks, laptops and the like. A native application which runs on a device at any given moment, whether the operating system or any other application, generates frame rendering commands. Native pixel values are also generated by such native applications which dictate the values used by the display controller for controlling a given pixel. Also dictated by the native application or the operating system is the native BLIL used across the display or locally.

An observed pixel's color, as perceived by a user, is a function, among other things and at a given ambient lighting conditions, of the BLIL and a pixel's value. A change in the BLIL is very noticeable by a user as the brightness of the image or an area in an image will be changed. In the context of power saving, a reduction in BLIL for the purpose of power saving, will reduce the brightness of an image or an area in an image and will affect the entire user experience and the quality of the image as perceived by the user. A BLIL change which is not followed by any pixel value compensation may also change the color scheme of the image or the color tone in at least some of the objects. On the other hand, any change of the pixel values is also very noticeable by a user. Increase or decrease of any component in the pixel triplet will also change the overall color scheme of an image.

Therefore, according to one aspect of the invention, the native BLIL of an image or an area of an image is decreased and followed by an increase in the native pixel's value. The increased pixel values (called here corrected pixel values) tend to increase the brightness of the pixel. In some color models, like HSV, it is also possible to increase just the V (Value) component in order to increase the pixel brightness and to compensate for the reduction in brightness of this pixel due to the reduced BLIL.

In this way, the Power Save System (PSS) 100 of the present invention, saves power while minimizing image quality reduction. The PSS 100 reduces the native BLIL and changes the native pixel values as generated by the native application into a set of corrected pixel values, so that the observed pixel color is as close as possible to the observed pixel color as it should have been in the original image based on the native BLIL and native pixel value.

As an example, if the BLIL is set at value 255 (max) and RGB are each set at 128 then the screen looks gray. However, if BLIL is then reduced to 128 and RGB is maintained at 128, to the user's eyes the gray screen will now look darker. However, if the reduction of the BLIL from 255 to 128 is followed by correcting the pixel's value of RGB to 255, the entire gray screen will be almost as in the original gray screen. It is worth noting that the decrease in the BLIL is not necessarily proportional to the increase in the pixel value it's only for the sake of simplicity in the example.

The PSS 100 may comprise according to this aspect of the invention, a Frame Pixel Sampling Module (FPSM) 102, a Sampled Pixel Analyzing Module (SPAM) 104, and a Correcting Module (CM) 106, as shown in FIG. 1. The PSS may run transparently over the operating system or any other application. The PSS's FPSM and SPAM may run continuously or intermittently at different frequencies. The frequency may be dynamic and change over time as will be described below. During run time of an individual application or game, these modules sample native frame pixels from the frame buffer and analyze their native pixel values.

In addition, the SPAM monitors the BLIL for each sampled pixel. The sampling process may cover only a fraction of an original frame pixels. A frame analysis may be done by sampling only a certain percentage of the frame's pixels. According to this aspect of the invention, sampling below 1% of the total frame pixels may provide a sufficient proximity to the pixel values distribution of the entire original frame. According to another embodiment sampling 0.005%-0.2% of the total frame pixels may also provide a sufficient proximity to the original distribution of the pixel values over the entire frame. Oversampling may be counterproductive and result in higher overhead of power consumption and it may also slow down the application due to CPU over usage.

Therefore, according to this aspect of the invention, the economies of balance may be calculated and monitored on the fly in order to make on/off decisions on the fly for the PSS or for changing the frequency in which it runs. Once the PSS gets the native pixel values and the BLIL, a decision is made whether there is an opportunity to save power. If so, as explained below, the CM will generate a corrected set of pixel values (108 in FIG. 1) and a corrected BLIL (110 in FIG. 1) and will update these values in the frame buffer (112 in FIG. 1) so that the frame is rendered with the corrected values.

According to another aspect of the invention, an optimization process may be applied in order to optimize the amount of resources invested in sampling and analyzing frame pixels and the amount of power which can be saved in order to economically justify the process. The optimization process is described below.

Figure 2:
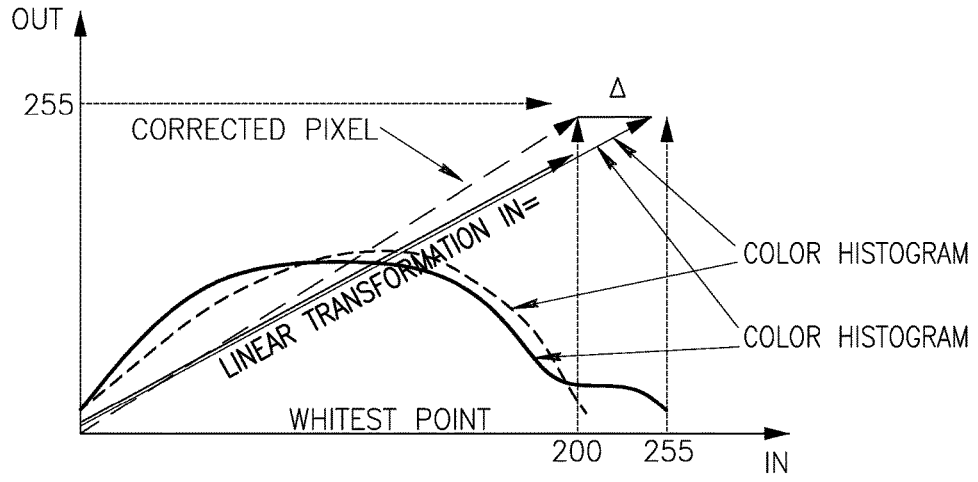
FIG. 2 illustrates an ideal frame in which the pixel values of the whitest point are less than the maximal pixel values possible.

Sampled pixels may be analyzed by two methodologies. According to the first methodology, a color histogram is calculated in order to know the color distribution in the frame. This gives an indication for the color space in the frame and the pixel values of the whitest point. FIG. 2 shows two non-limiting examples of possible color histograms of a frame. The pixel value of the whitest point in histogram I is 200 while the whitest point in histogram II is 255. Known prior art systems use the same pixel values generated by the native application as the output values for the display. This is shown for histograms I and II in the short and long arrows where output=input respectively. According to this aspect of the current invention and referring to histogram I, the PSS samples and analyzes this frame to identify the native pixel values distribution and the whitest point, at 200 in this example and reduces BLIL. To understand better using a real life example, on a Nexus 5 device, stretching the histogram from 200 to 255 will allow back light level reduction from 127 to 75. Note however, that this data is specific to the mentioned device, since on each device the mapping between the back light level (which is usually in the range 0-255) maps differently to actual intensity of light emitted by the display. Also, how back light level maps to power consumption varies between devices, although the thumb rule of higher back light level causes higher power consumption generally holds. In addition, PSS corrects native pixel values as shown in the corrected pixel line. All native pixel values in the frame buffer are corrected based on this linear transformation so that their brightness is increased. The room to increase the native pixel values dictates the room to decrease the BLIL without affecting the quality of the original image. It should be emphasized that the correction in the native pixel values in the frame buffer is made to all of the native frame pixel values and not only to the sampled pixels in the frame. Correcting only the sampled pixels will result in an artifact. Histogram I shows an ideal situation in which the whitest point in the frame is 200 which is less than the maximum value possible which is 255 in this example. This means that there is a space equal to 255 minus 200 (55) into which pixel values can be increased. According to the linear correction function shown in FIG. 2, each pixel value is increased by a multiple equal to the ratio of 255/200. As will be discussed below, a linear transformation is only one embodiment while other non-linear transformations of native pixel values into corrected pixel values may be possible in other embodiments. Moreover, a non-linear transformation may not necessarily increase all native pixel values and as discussed below in some cases native pixel values may be decreased in certain embodiments in order to achieve a better color contrast in the corrected image.

Histogram I in the FIG. 2 shows an ideal frame in which the pixel values of the whitest point are less than the maximal pixel values possible (which in this example 255). For such a frame, after analyzing the frame, the PSS will identify an opportunity to save power by increasing native pixel values followed by a decrease in BLIL. However, histogram II in FIG. 2 is a more realistic histogram. As shown in this histogram II, the color space spans across the entire spectrum between 0 to 255. In this case, the whitest point is already 255 and there is no room to stretch the histogram in order to compensate for a BLIL reduction unless a washout artifact is created. According to this example, data represented by pixels having pixel values between 200 and 255 will be washed-out. This area is defined by Δ in FIG. 2. According to this aspect of the invention, SPAM of the PSS may define a threshold value to define a Cut Off native pixel value above which a washout artifact is acceptable. Regarding the histogram II in FIG. 2, a Cut Off value may be defined at 200. As mentioned above, this means that a washout artifact will occur to all data represented by pixels in Δ area. Washing-out this data of the brightest range of native pixel may cause, for example, losing white clouds in a bright sky. However, if this artifact is acceptable in terms of image quality, doing it opens space to increase native pixel values having values smaller than the cut off value as shown again in the corrected pixel line in FIG. 2. A threshold value to define a cut off native pixel value may be for example 95% or 99% (percentile histogram). According to another example, it may be any percentage between 95% and 100%. According to another embodiment of the invention, a cut off value for native pixel values may be applied even if based on the image color histogram the whitest point is less than the maximum value possible. Such a decision may be made due to a specific histogram distribution having a tail in the higher brightness region which represents only a small percentile of the entire frame and if washed-out the resulting artifact may still be acceptable by a user due to this nature of the color distribution of an image or an area in an image and more power can be saved. A threshold value may be defined by the PSS in order to make a decision whether to apply a cut off mechanism for a certain histogram profile.

According to another methodology for pixel frame sampling, bright areas in the frame are identified. According to this aspect of the invention, FPSM divides the frame into sub-frame areas. SPAM analyzes sampled pixels from each sub-frame area separately by producing a sub-color-histogram to each sub-frame area. Based on average native pixel values in a sub-frame area, or based on the span of values exist in a sub-frame area, SPAM may define a sub-frame area as a bright area. SPAM may designate sub-frame areas as having more than just two brightness level—high and low. SPAM may for example divide and group sub-frame areas into 3 or 4 brightness levels. In addition, according to this aspect of the invention, based on a threshold for the amount and value of bright areas exist in a frame, PSS may decide whether to stretch a frame, accept a washout artifact but save power by reducing BLIL or whether to skip an opportunity to save power due to a too strong estimated artifact.

According to this aspect of the invention, PSS may be turned off once bright areas in the frame are above one or more predefined thresholds representing one of the size or the number or the average color level or the color span. Alternatively, a decision may be made to decrease BLIL to a lesser degree and to also correct pixel's values accordingly (to a lesser degree). The bright areas may be dispersed more or less generally throughout the frame or may be concentrated in one area in a frame. As an example, in a frame there might be a central portion includes a bright image, but might have the same overall brightness as in the dispersed example, so modifying the BLIL and pixel values may need to be done taking this into consideration and thus dividing the fame into a set of sub-frames which are analyzed might be beneficial is setting the BLIL and pixel values.

In order to economically invest power and resources to sample and analyze frames, careful power management may be applied. One example of an optimization process for this power management process may be as follows. On every frame (or every few frames, at a fixed or dynamic frequency) the Expected Power Save (EPS) can be calculated by the SPAM. The amount of possible BLIL reduction (power save) is a function of the ability to increase a pixel's values. The lower the original pixel value, the more room exists to increase these values and therefor the higher possibility to save power. EPS may be calculated based on the difference between the estimated cost of frame sampling and analysis and the expected power reduction due to a reduced BLIL. According to this aspect of the invention, PSS may define a threshold value for the EPS above which it is economically justified to turn on the CM. Stated another way, a positive EPS or an EPS above a predefined threshold value may provide an indication to turn PSS on while a negative EPS or an EPS below a predefined threshold value may provide an indication to turn PSS off or to reduce the frequency on which FPSM works to sample frames. It has been found, based on measurements, that frame analysis as discussed herein may introduce costs in terms of power consumption. In certain devices, the cost in power may be approximately 3 mA-5 mA on the average. However, these values may be different from one device to another. PSS runs frame sampling and frame analysis at a certain frequency in order to monitor possibilities for power saving. In other words, PSS consumes power in order to detect opportunities to save power. According to another aspect of the invention, there is provided a method to save the power consumed by the FPSM and SPAM. PSS may gradually reduce a small amount of the BLIL which is hardly noticeable by an observer. Moreover, in another embodiment, pixel's values may also be slightly but gradually increased by PSS to compensate for this small decrease in BLIL to further improve this hardly noticeable image change. As long as the power save achieved equals and balances the power consumed for the FPSM and for the SPAM to run there is an economic justification to run PSS. Along the process of the frame analysis EPS values are monitored. If, for example, the EPS values are stable over a predefined number of samples, then PSS may reduce the frequency of the FPSM and SPAM until a change in the EPS is higher than a certain threshold. As long as EPS stays the same the BLIL reduction stays the same and therefore, pixel values are increased in the same amount.

Figure 3:
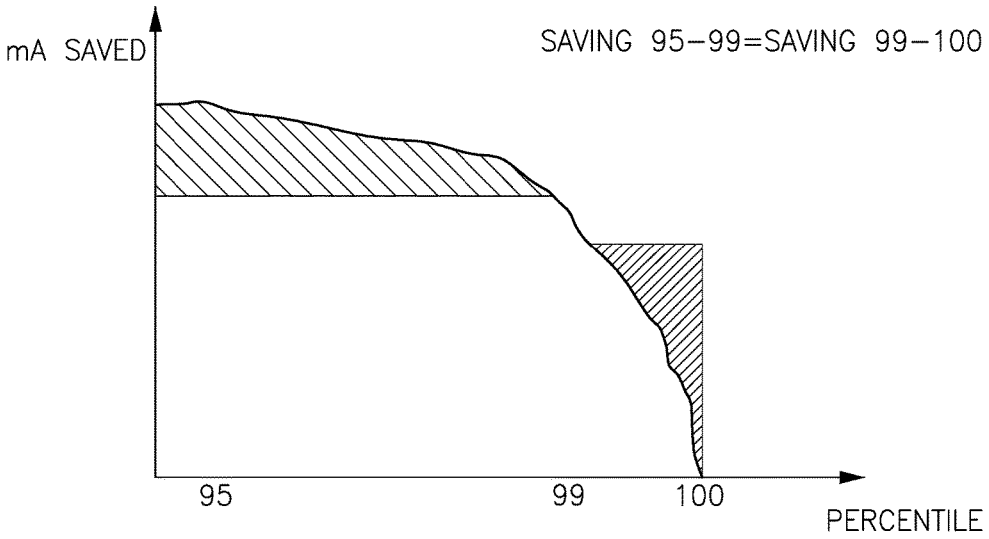
FIG. 3 represents a typical relationship between power saved and percentile histogram stretching.

A typical relationship between power saved and percentile histogram stretching is shown in FIG. 3. The results shown in FIG. 3 are based on experiments performed over a large number of frames from which it has been found that potential power saved by stretching a native frame color histogram anywhere along the range starting from the 95 percentile up to the 99 percentile equals the potential power save due to stretching such histogram at the 99 percentile. Although histogram stretching at any cut off native pixel value along the range of 95-99 percentile ends up with a similar power save as if the cut off native pixel value would have been 99, there is a big difference in terms of image quality as perceived by a user. While below approximately percentile 99 histogram stretching ends up with a noticeable reduction in image quality, a 99 percentile cut off pixel value is bearable by user. Therefore, according to this aspect of the invention there is disclosed a PSS which practices a percentile histogram stretching having a cut of native pixel value at approximately about the 99 percentile.

Figure 4:
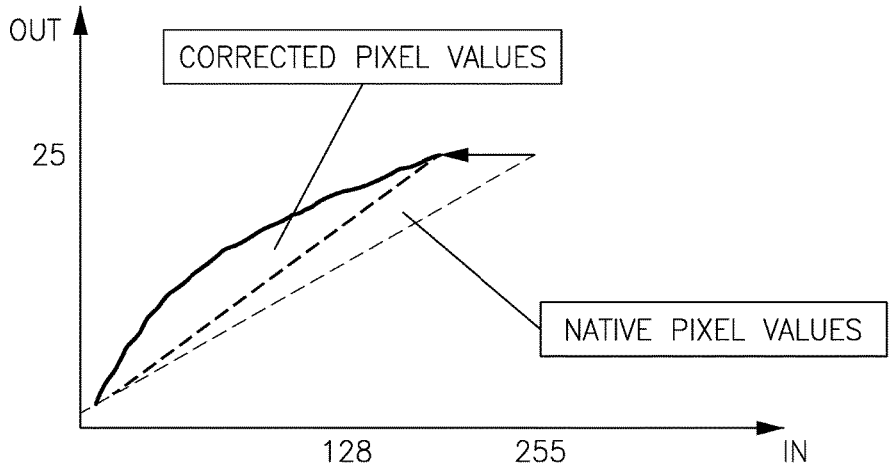
FIG. 4 illustrates an example of a non-linear native pixel correction function.

Referring now to FIG. 4 which shows an example of a non-linear native pixel correction function as mentioned above.

According to this aspect of the invention, there is provided a curved native pixel correction function which does not increase each native pixel value by the same amount or the same relative amount. This curved correction function has been found to provide a better image quality than the linear correction function. This curved correction function is characterized by a higher increase of native pixel values around the midpoint of an image histogram while practicing a relatively smaller increase of native pixel values at the edges of the histogram—where darker and brighter pixels are located. It should be emphasized that a curved correction function is characterized on every point along the curved line by a tangent line. This tangent line has a different slope on each point on the curve. The slope of the tangent line to the curved line provides an indication, in that area, to the amount of detail loss along the out axis. Using less possible value range to represent what was originally a bigger value range will naturally result in potential detail loss, since there are less discrete options to utilize. As can be seen, the detail loss is low around the darker native pixels and is increased toward the higher native pixel values. In general, at pixel values below the midpoint, there is a decrease in the output detail loss. However, at pixel values above the midpoint, there is an increase in the output detail loss relative to the input resolution. An increased detail loss means a smaller contrast in those areas which may lead to some loss of information at that point. As one can see from the shape of the curved correction function, the transformation from the native pixel values into the corrected pixel values result in a reduction of the image contrast.

Figure 5:
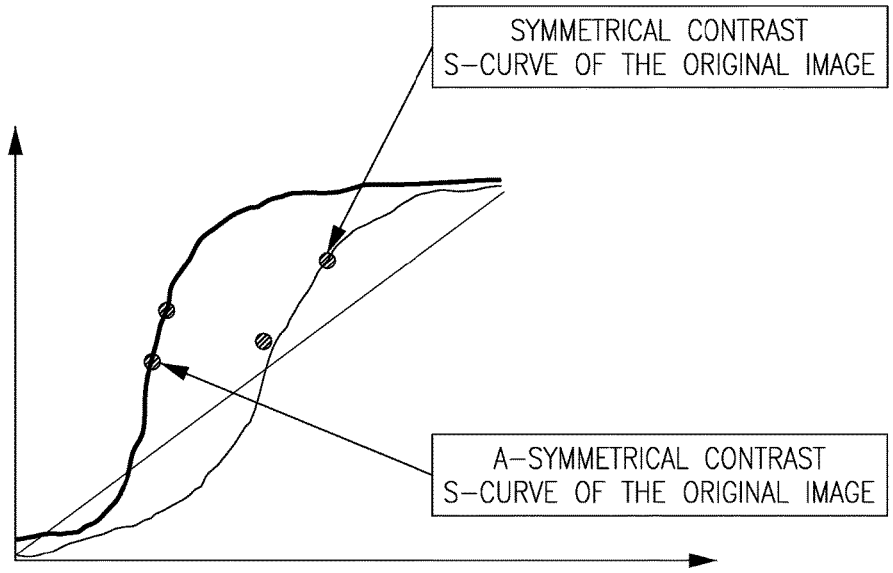
FIG. 5 illustrates an a-symmetrical s-curve correction function.

Therefore, according to another embodiment of the invention, FIG. 5 illustrates symmetric and a-symmetric native pixel correction S-curves. As mentioned above, another aspect of the present invention is not always to increase all native pixel values but in some cases to sacrifice some potential to reduce BLIL, for the sake of keeping a good image contrast. In a S-curve, native pixel correction function increases the native pixel values of the bright pixels and it makes them brighter while it decreases the native pixel values of the darker pixels and it makes them darker. As a result, image contrast is improved, but power saving may be reduced. The reason for a reduced power saving is due to the fact that BLIL cannot be decreased in the same amount it could have been decreased should all the native pixel values had been increased. The potential to save power is a function of the number of native pixels which are corrected to a higher value relative to the number of native pixels which are corrected to a lower value. Therefore, in a symmetrical S-curve, less power can be saved while in an a-symmetrical S-curve, where the ratio between the number of native pixels' values which are increased to the number of native pixel values which are decreased is higher, there is more room for power saving. In a symmetrical S-curve correction function, the midpoint of the image color histogram is located on the same spot as in a linear correction function. In this situation the ability to save power is more limited as there are relatively low number of native pixels which become brighter. In an a-symmetrical s-curve correction function however there are more native pixels which are converted into brighter pixel values than native pixels which are converted into darker pixel values and therefore there is more room for BLIL reduction and power saving. In an a-symmetrical s-curve correction function the midpoint of the corrected curve is shifted in comparison to its position in a linear correction function as shown in FIG. 5.

In the above embodiments PSS, was described as software which may be run on a stand-alone portable device. In the context of that embodiment the invention describes optimizing processes and checking the economic justification for practicing PSS. In the stand-alone mobile device context, due to limited on-board resources and competing demands between the sampling and analysis steps and the real time computational needs for the running applications, optimization and justifications are critical. However, in another embodiment of the present invention, the load, in certain occasions, may be divided between at least two separate devices. In this context, not all of the devices are battery operated and therefore, power saving considerations are less critical. For example, one device may be a server computer and the second device may be a mobile client device. This is, in fact, a typical situation in a video streaming environment in which the video is stored on a storage device and is streamed through a server into a mobile client. The challenges of reducing power consumption in a portable battery operated mobile device become less relevant when it comes to a server which has a continuous power supply. Therefore, according to the embodiments described below, at least part of the PSS process may be performed in advance so that less computational work is needed to be performed by a mobile client device and therefore more power can be saved in the mobile client device. As will be described below, another aspect of the invention is the ability to perform the preprocessing of a frame or a set of frames in advance and to store the analyzed results or the corrected pixel values and the corrected BLIL in such a way that it can be used on the fly by the mobile client device.

The terms video and stream are used throughout this patent application and have essentially the same meaning, that is, any representation of a sequence of images, a file stored in a data storage device, in memory, and streaming such file offline or live (like in sports events as an example).

Alternatively, according to another aspect of the invention, instead of doing all of the analysis and pixel value changes in real time on the end user device, it can be done prior to the end user viewing it on the device.

The preprocessing processes, which include sampling and analyzing frames, may be done on any existing file on a storage device or by any application which creates the original video. According to this embodiment, in which the preprocessing is being done in advance, there might be more than one version of the file—the original version and the preprocessed version containing at least some of the preprocessing results. Alternatively, an updated version of the original file may be created which contains this information. Preprocessing results may include, among other things, corrected pixel values or range of corrected pixel values, corrected BLIL or a range of potential BLILs for each set of corrected pixel values or EPS for each BLIL in the range. According to another embodiment, preprocessing may also occur on the mobile client device, as mentioned above, however in the current context this may be done before viewing the video on the mobile device when, for example, it is idle, before running the video for the first time, during the first time the video is viewed, while the device is connected to a power source or by scheduling it by the user. In all these cases, preprocessing is characterized by less demanding situations where even for the battery operated device saving power or computational power is less of an issue. According to this aspect of the invention, where sampling and analyzing is separated from the real time video playing, there is provided a file version in which corrected values are embedded. Such corrected values are characterized by the ability to reduce the power consumption of the device on which they run. According to this embodiment, sampling rate may be higher as it is being performed under less power demanding conditions.

Another advantage of doing the preprocessing phase off line is due to the fact that when time, power and computational resources are less of an issue, more complex frame analysis and pixel value corrections can be assessed and implemented, providing smaller image quality deterioration and/or better EPS.

According to this aspect of the invention, the preprocessing results will be embedded into the original file or into a new version of the original file as a set of metadata for each frame or for a subset of frames. A frame's or a set of frames' metadata may include a native BLIL change instructions, a corrected BLIL that should be used, or the transformation of the native BLIL that should be done, such as, for example:

the delta change that should be applied on the native BLIL, a factor that should be applied on the native BLIL, any mathematical function describing moving from native BLIL to the corrected BLIL matching the pixel values, by using a mathematical function representation, or simply by a LUT (Look Up Table). In addition, according to another aspect of the invention, any decision or calculation in relation to the corrected BLIL may also take into consideration the client ambient lighting condition and device properties, such as display type, power consumption on each BLL, and BLL effect on emitted light intensity. In addition, as said above, corrected values both for pixels and BLIL may be done on a full frame basis or on the basis of any frame region or set of frame regions.

Metadata frequency may be embedded in the file (whether original or any version of the original) on different levels, such as globally for the entire video, once every certain amount of time or certain frame intervals in the video, for every frame or for a region inside a frame. The client device may correct native pixel values and/or native BLIL according to the metadata frequency. A simple example would be one static modification of the BLIL in the beginning of the video playback; a more advanced example would be changing the native BLIL value and/or native pixel values in different ways on different parts of a video, an image or a frame.

According to one aspect of this invention, when a video file, for example, is stored on a server it may be stored in two or more versions, representing corrected pixel values, which will provide different levels of EPS when viewed on the client device with a reduced BLIL. An original version of the video which is configured to render the images with the native pixel values may be stored as well. The stored video files may contain meta-data, especially for instructing the client device how to correct the BLIL while displaying the video. In the case that there is more than one available stream, the client may request any of the available streams based on their EPS, which is naturally linked to the expected visual quality impact. For example, one possible logic on the client device is to request streams with stronger EPS as the battery becomes more depleted, or as the device heats up.

According to another aspect of the invention, a client device into which a video is about to be streamed from a server can send the server its current state, such as for example, BLIL and/or ambient lighting conditions, battery level, components and overall temperature, BLIL effect on power consumption, BLIL effect on perceived pixel color, or available computational resources. In response, the server can start streaming an optimized processed version of the video and/or metadata. As a simple example, knowing the user ambient condition, the metadata may contain the absolute BLIL that should be used to provide a good or at least acceptable viewing experience. In a more advanced example the video content may be used to even further improve the provided BLIL value, providing a good user experience, while reducing even more power.

According to another aspect of the invention, the client device may offload the metadata calculation from the client device to be performed on the server so that the analysis of the frames can be used by mobile device. The native pixel values of the stream or video will be kept as is, and the extra metadata and general frame analysis will be provided for the client device to use. Better EPS and/or visual quality can be expected, since the processing can be more advanced and also calculating it doesn't increase the power consumption on the device (resulting in smaller overall power save). In this aspect of the invention, the client device will still need to change the pixel values through a CM.

According to yet another embodiment of the present invention, at least one of the FPSM, SPAM or CM may be done partially by the server and partially be the client device. Doing the work in two levels may lead to an increased power save and more efficiently usage of available resources at different stages or complexity levels.

Another aspect of the invention is described below which is related to the way of way native pixel values and native BLIL may be changed. In order to practice the pixel manipulation as described above, there is provided according to one embodiment of the present invention an example of an add-on code which may be added to graphics or to operating system libraries (for example, OpenGL on Android OS), especially for Shaders that run on the GPU. The image buffer native pixel values are altered to compensate for the reduced BLIL.

Note: shader code examples are partly in pseudo code and not pure GLSL syntax.

Original Shader:

```
precision mediump float;
uniform samplerExternalOES baseSampler;
void main(void) {
  gl_FragColor = texture2D(baseSampler, outTexCoords);
}
```

Hooked Changed Shader:

```
vec4 lucidColorAdjust(vec4 orig, vec4 parameters)
{
  // Color value manipulation in order to compensate BLIL change
  // ...
}
precision mediump float;
// uniform which delivers this frame's specific color adjustment parameters
// according to the frame analysis
uniform vec4 lucidFactor;
uniform samplerExternalOES baseSampler;
void main(void) {
  gl_FragColor = texture2D(baseSampler, outTexCoords);
    // This is the added code a call to the color transform function
  gl_FragColor = lucidColorAdjust(gl_FragColor, lucidFactor);
}
```

According to one embodiment, the correction of the native pixel values is especially initiated by the PSS so that a dedicated full pass over the entire frame buffer is being done and native pixels' values of an image are corrected by a CPU, or by a GPU, or by a DSP unit, or by any computational unit that is found on the client device. While it may provide the desired image quality, it sometimes reduces the overall power savings significantly due to this special and dedicated full pass.

According to another embodiment, when an active application is running on a client device, there might be a pass of processing going over all of the pixels from time to time. According to this embodiment, PSS may be configured to identify and use these passes to correct native pixel values or native BLIL. Using an existing processing pass to correct values instead of initiating a dedicated pass may reduce power consumption and increase power save. It should be emphasized that the extra overhead introduced is minor. There are few scenarios where such code "patching" is possible.

Alternatively, according to another embodiment, patching is possible when the application uses a rendering API that allows running code per image output pixel. While this is relevant for any OS, to allow easier explanation we will focus mostly on the Android OS, however, the system and methods still hold for other OS and graphic related libraries. In the Android system, some of the applications use OpenGL shaders. For example:

Original Shader:

```
precision mediump float;
uniform samplerExternalOES baseSampler;
void CompositorMain(vec2 pos, vec2 size) {
  gl_FragColor = texture2D(baseSampler, outTexCoords);
}
```

Hooked Changed Shader:

```
vec4 lucidColorAdjust(vec4 orig, vec4 parameters)
{
  // Color value manipulation in order to compensate BLIL change
  // ...
}
precision mediump float;
// uniform which delivers this frame's specific color adjustment parameters
// according to the frame analysis
uniform vec4 lucidFactor;
uniform samplerExternalOES baseSampler;
void CompositorMain (vec2 pos, vec2 size) {
  gl_FragColor = texture2D(baseSampler, outTexCoords);
    // This is the added code a call to the color transform function
  gl_FragColor = lucidColorAdjust(gl_FragColor, lucidFactor);
  }
```

Another possible scenario is that the app doesn't utilize Shaders directly, but, the OS framework code does use such shaders. For example, OS components responsible for composition of the final displayed image from few applications or activities may use such shaders (On Android some options are SurfaceFlinger, HW and GLES composer, on another example, on Windows it is called DWM—Desktop Windows Manager), allowing an opportunity to patch the existing shaders and have the desired values correction with minimal power cost.

Example I

If the application itself does use the graphic library, either directly or indirectly, by other components in the OS (e.g. OpenGL in the Android OS), the Shaders need to be changed in order to allow overriding the output pixels value.

This can be done in several ways, on each of them the common principle is that shader native compiling and/or loading native functionality is changed and different shaders are in fact being used.

In one scenario, function hooking method is used. Function hooking means that an application or a component is manipulated in a way that makes every call to function X inside component Y actually go into a different component Z. This component Z can simply call the original function X inside component Y, but it may also do anything else that is desired, for example, change the parameters being passed to the function, call other functions as well, remove the call to the original function etc.

Another scenario is that a proxy library is provided, which exposes a similar interface as the original library, but can manipulate any command/function call going through it, while being responsible for calling the original library when desired. Usually, a snippet of code will be added to the existing shader functionality, either to the textual representation of the shader to be compiled later, or to the assembly or machine code of the shader.

Another scenario is changing the original library (for example, OpenGL on Android OS). In this scenario, when a shader is loaded/compiled, it will be changed and manipulation of the pixel output values (to compensate for the BLL change) will be performed.

Example II

Similarly, hooking in the above mentioned methods, or by adding code directly into the libraries and/or framework code, can be done in order to peek at the pixel values that are intended to be displayed and analyze the frames in order to choose the most suitable pixel value change that is needed. As previously described, the frame can be statistically or entirely sampled and processed by the CPU/GPU/DSP unit or any computational unit on the client device.

Figure 6:
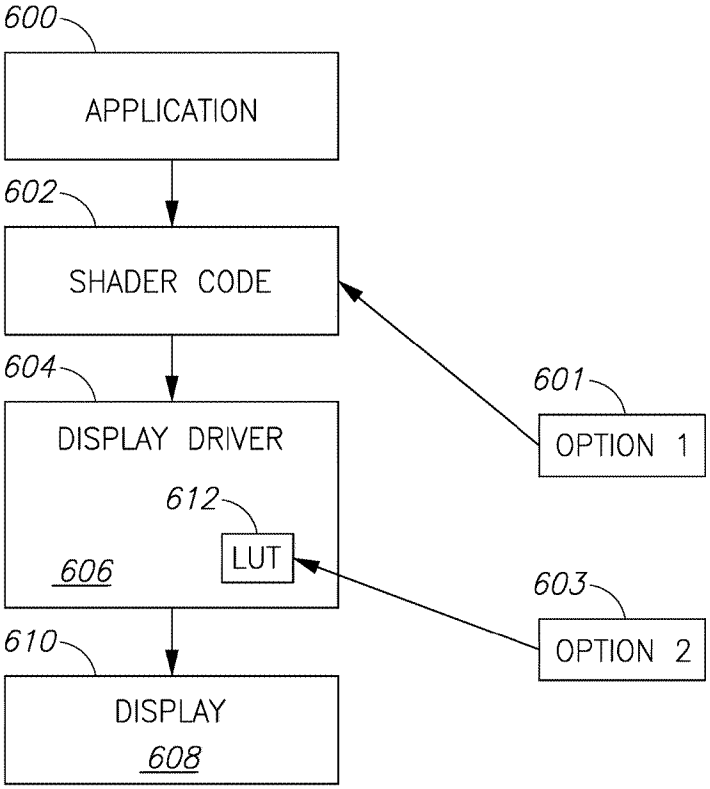

Turning now to FIG. 6, this figure in flowchart form illustrates the operation of modifying the BLIL and the pixel value in accordance with one or two options. These options are: (1) adding code in the form of instructions to the GPU shader in order to change the pixel value or (2) using a look-up table (LUT), both of which features have been described above. In step 600, one of a sequence of one or more frames for an application that is to be modified is presented. If option 1 (601 in FIG. 6) is implemented, add-on code in step 602 may be added to the GPU shader that will change the pixel value. If option 2 (603 in FIG. 6) is implemented in step 604, a LUT 612 is accessed to provide settings for corrected BLIL and pixel values for a particular application or game is sent to the display driver 606 which in turn then commands the display 608 to display the corrected frame or frames in step 610. It is to be noted that preferably the above options operate usually but not exclusively in live, dynamic circumstances when the mobile device is not tethered to a mains source and the operations, such as playing an application like a game are carried out using battery power. In situations in which the mobile device is connected to a server, as described herein, the server being connected to a mains source, the techniques described herein present less of a burden.

Figure 7:
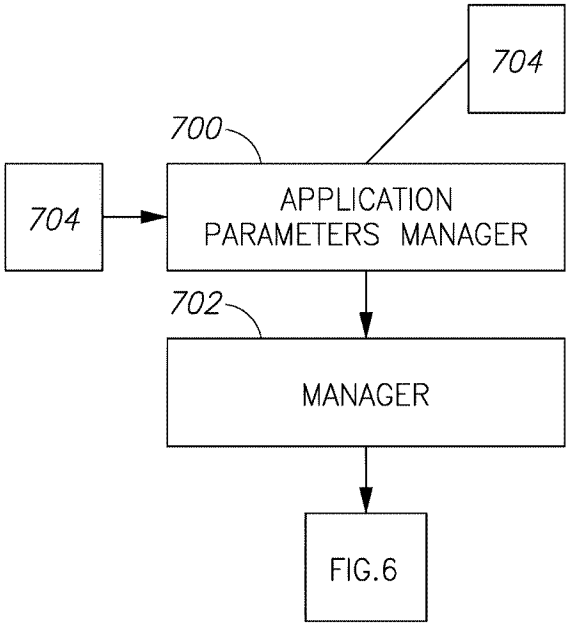
FIGS. 6 and 7 illustrate in flowchart fashion the operation of the present invention.

Turning now to FIG. 7, this figure illustrates the cooperation of an Application Parameters Manager 700 with a Manager 702. FIG. 1 of related and incorporated Ser. No. 15/249,669 and its related text in the specification of that application illustrate a similar systems structure as maybe herein envisioned.

The Applications Parameters manager 700 may be informed, by an Android system 704, what the current foreground application is displayed or to be displayed on the device screen. It is to be understood that although the Android operating systems id referred to herein, the present invention is not limited to Android and may be implemented in any other suitable operating system, including but not limited to iOS or Microsoft Windows. In any case, the Applications Parameters manager informs the Manager 702 what is the current foreground application and instructs the Manager which parameters to impose on the display of that foreground application. Such parameters include: (a) the level to which the BLIL is to be reduced; and (b) the level to which the pixel value is to be increased. The amounts of change, if any, in either of the BLIL or the pixel values are determined on an application-by-application basis, taking into consideration the user's experience changes that would be experienced if and depending on the levels of such changes, if any. Also, the Application Parameters manager my also provide further parameters for a specific application or game for example depending on, by way of example only, whether the application or game occupies the full display screen and the color distribution of the display, as discussed above. Finally, the Application Parameters Manager may maintain and manage a database of different parameters for each application or game (such as in a LUT like that shown as 612 in FIG. 6) and transmit selected parameters to the Manager 702 to implement. The Manager interacts with the flowchart shown in FIG. 6 as follows. The Manager 702 controls and adds the add-on code discussed above in reference to FIG. 6, step 602. In addition, the Manager 702 controls and forwards a message to the Display Driver 606 and the LUT 612 shown in FIG. 6 to, for example, change the color of frames to be displayed.

What we claim is:

1. A method of reducing power consumption in a computing device having a back light display while maintaining image quality comprising:

determining one or more native pixel values and a native backlight intensity level of two or more image frames;

calculating an expected power consumption savings based on the difference between (1) an estimated cost of frame sampling and analysis and (2) an expected power consumption reduction due to reducing the native backlight intensity level;

determining that the expected power consumption savings satisfies a predetermined threshold;

based on determining that the expected power consumption savings satisfies the predetermined threshold, reducing power consumption in the computing device by:

sampling and analyzing the two or more image frames to determine a decreased backlight intensity level and one or more corrected pixel values;

reducing the native backlight intensity level to the decreased backlight intensity level; and adjusting the one or more native pixel values to the one or more corrected pixel values.

2. The method of claim 1, wherein the decreased backlight intensity level and the one or more corrected pixel values are determined so that an observed pixel color to a user is substantially the same as an observed pixel color based on the native backlight intensity and the native pixel values.

3. The method of claim 1, wherein sampling and analyzing the two or more image frames to determine the decreased backlight intensity and the one or more corrected pixel values comprises:

sampling native frame pixels in a frame buffer;

analyzing the native frame pixels to determine native pixel values;

monitoring a back light intensity for the sampled native frame pixels; and generating the one or more corrected pixel values and the decreased backlight intensity.

4. The method of claim 1, wherein the steps of sampling and analyzing the two or more image frames, reducing the native backlight intensity level and adjusting the one or more native pixel values are performed on an application-by-application basis.

5. The method of claim 3, wherein the steps of sampling, analyzing, monitoring, and generating are implemented on an application-by-application basis.

6. The method of claim 1, wherein the computing device is a battery-powered mobile device.

7. The method of claim 6, wherein the battery-powered mobile device is a first computing device, the method being performed by a second computing device that communicates with the first computing device; and wherein:

reducing the native backlight intensity level to the decreased backlight intensity level comprises providing, by the second computing device and to the first computing device, data indicating the determined decreased backlight intensity level; and adjusting the one or more native pixel values to the one or more corrected pixel values comprises providing, by the second computing device and to the first computing device, data indicating the determined one or more corrected pixel values.

8. The method of claim 7, further comprising:

storing, by the second computing device, the data indicating the determined decreased backlight intensity level and the data indicating the determined one or more corrected pixel values;

receiving, by the second computing device, a request from the first computing device for a corrected image frame;

providing, by the second computing device and to the first computing device, the data indicating the decreased backlight intensity level and the data indicating the one or more corrected pixel values in response to receiving the request for the corrected image frame.

9. The method of claim 7, further comprising receiving, by the second computing device and from the first computing device, data indicating one or more of an ambient light condition, a battery state of the first computing device, a backlight intensity, or a mobile device temperature; and wherein calculating an expected power consumption savings comprises calculating, by the second computing device, an expected power consumption savings based on the received data.

10. The method of claim 1, wherein sampling and analyzing the two or more image frames to determine the decreased backlight intensity level and the one or more corrected pixel values comprises determining, by a GPU shader, the decreased backlight intensity level and the one or more corrected pixel values, wherein the GPU shader includes one or more software instructions to alter a pixel value.

11. The method of claim 1, wherein sampling and analyzing the two or more image frames to determine the decreased backlight intensity level and the one or more corrected pixel values comprises determining the decreased backlight intensity level and the one or more corrected pixel values by accessing a lookup table, wherein the look-up table is pre-loaded with instructions for determining the decreased backlight intensity level and the one or more corrected pixel values on an application-by-application basis.

12. A system for reducing power consumption in a computing device, the system comprising:

one or more processors; and one or more non-transitory computer-readable media having instructions stored thereon that, when executed by the one or more processors, cause performance of operations comprising:

determining one or more native pixel values and a native backlight intensity level of two or more image frames;

calculating an expected power consumption savings based on the difference between (1) an estimated cost of frame sampling and analysis and (2) an expected power consumption reduction due to reducing the native backlight intensity level;

determining that the expected power consumption savings satisfies a predetermined threshold;

based on determining that the expected power consumption savings satisfies the predetermined threshold, reducing power consumption in the computing device by:

sampling and analyzing the two or more image frames to determine a decreased backlight intensity level and one or more corrected pixel values;

reducing the native backlight intensity level to the decreased backlight intensity level; and adjusting the one or more native pixel values to the one or more corrected pixel values.

13. The system of claim 12, wherein the operation of sampling and analyzing the two or more image frames to determine the decreased backlight intensity level and the one or more corrected pixel values comprises determining, by a GPU shader, the decreased backlight intensity level and the one or more corrected pixel values, wherein the GPU shader includes one or more software instructions to alter a pixel value.

14. The system of claim 12, wherein the decreased backlight intensity level and the one or more corrected pixel values are determined so that an observed pixel color to a user is substantially the same as an observed pixel color based on the native backlight intensity and the native pixel values.

15. The system of claim 12, wherein sampling and analyzing the two or more image frames to determine the decreased backlight intensity level and the one or more corrected pixel values comprises:

sampling native frame pixels in a frame buffer;

analyzing the native frame pixels to determine native pixel values;

monitoring a back light intensity for the sampled native frame pixels; and generating the one or more corrected pixel values and the decreased backlight intensity.

16. The system of claim 12, wherein the operations of sampling and analyzing the two or more image frames, reducing the native backlight intensity level and adjusting the one or more native pixel values are performed on an application-by-application basis.

17. The system of claim 12, wherein the computing device is a battery-powered mobile device.

18. The system of claim 17, wherein the battery-powered mobile device is a first computing device; and the one or more processors and the one or more non-transitory computer-readable media are one or more processors and one or more non-transitory computer-readable media of a second computing device; and wherein:

reducing the native backlight intensity level to the decreased backlight intensity level comprises providing, by the second computing device and to the first computing device, data indicating the decreased backlight intensity level; and adjusting the one or more native pixel values to the one or more corrected pixel values comprises providing, by the second computing device and to the first computing device, data indicating the one or more corrected pixel values.

19. The system of claim 12, wherein sampling and analyzing the two or more image frames to determine the decreased backlight intensity level and the one or more corrected pixel values comprises determining the decreased backlight intensity level and the one or more corrected pixel values by accessing a lookup table, wherein the look-up table is pre-loaded with instructions for determining the decreased backlight intensity level and the one or more corrected pixel values on an application-by-application basis.

20. The system of claim 18, further comprising:

storing, by the second computing device, the data indicating the decreased backlight intensity level and the data indicating the one or more corrected pixel values;

receiving, by the second computing device, a request from the first computing device for a corrected image frame;

providing, by the second computing device and to the first computing device, the data indicating the decreased backlight intensity level and the data indicating the one or more corrected pixel values in response to receiving the request for the corrected image frame.

* * * * *